US006755050B2

(12) United States Patent
Lindskog

(10) Patent No.: US 6,755,050 B2
(45) Date of Patent: Jun. 29, 2004

(54) SHEET ELEMENT AND ITS USE

(75) Inventor: Kjell Lindskog, Skelleftea (SE)

(73) Assignee: SQS Security Qube System AB, Skelleftea (SE)

( * ) Notice: Subject to any disclaimer, the term of this patent is extended or adjusted under 35 U.S.C. 154(b) by 0 days.

(21) Appl. No.: 10/344,025

(22) PCT Filed: Aug. 7, 2001

(86) PCT No.: PCT/SE01/01720

§ 371 (c)(1),
(2), (4) Date: Feb. 6, 2003

(87) PCT Pub. No.: WO02/12671

PCT Pub. Date: Feb. 14, 2002

(65) Prior Publication Data

US 2003/0194530 A1 Oct. 16, 2003

(30) Foreign Application Priority Data

Aug. 8, 2000 (SE) ..... 0002841

(51) Int. Cl.[7] ..... G08B 13/26
(52) U.S. Cl. ..... 66/170; 66/202; 340/561
(58) Field of Search ..... 66/202, 169 R, 66/170, 196; 340/550, 551, 552, 540, 541, 564, 565, 566, 567; 109/42, 24

(56) References Cited

U.S. PATENT DOCUMENTS 362,010 A * 4/1887 Jewill ..... 174/122 R
708,093 A * 9/1902 Sutton ..... 109/42
3,696,373 A * 10/1972 Dunn et al. ..... 52/664
5,539,379 A * 7/1996 MacPherson ..... 340/550
5,592,149 A * 1/1997 Alizi ..... 340/550
5,677,674 A * 10/1997 Wolf ..... 340/541
6,215,397 B1 * 4/2001 Lindskog ..... 340/550
6,400,268 B1 * 6/2002 Lindskog ..... 340/550

FOREIGN PATENT DOCUMENTS

WO 9323648 11/1993
WO 9502742 1/1995

* cited by examiner

*Primary Examiner*—Danny Worrell
(74) *Attorney, Agent, or Firm*—Mark P. Stone

(57) ABSTRACT

The invention relates to a sheet element (10) that has integrated therewith an alarm mat (2) and that is intended particularly for security containers and security spaces. The alarm mat (2) is comprised of light-conducting and/or current-conducting filaments or like devices. The alarm mat (2) includes a base mat (2*a*) and a supplemental mat (2*b*). The base mat (2*a*) has an essentially looped filament pattern of the kind, for instance, obtained with knitting or crocheting. The supplemental mat (2*b*) has a regular or irregular filament pattern. The base mat (2*a*) and the supplemental mat (2*b*) are tightly positioned together to form an alarm mat, wherewith the filament pattern of the base mat (2*a*) and the filament pattern of the supplemental mat (2*b*) deviate from totally coincidental overlap. The invention also relates to the use of the sheet element (10) as casing material in a container (20) or in a space intended for the storage of theft-attractive objects or the like.

20 Claims, 7 Drawing Sheets

SHEET ELEMENT AND ITS USE

Figure 1:
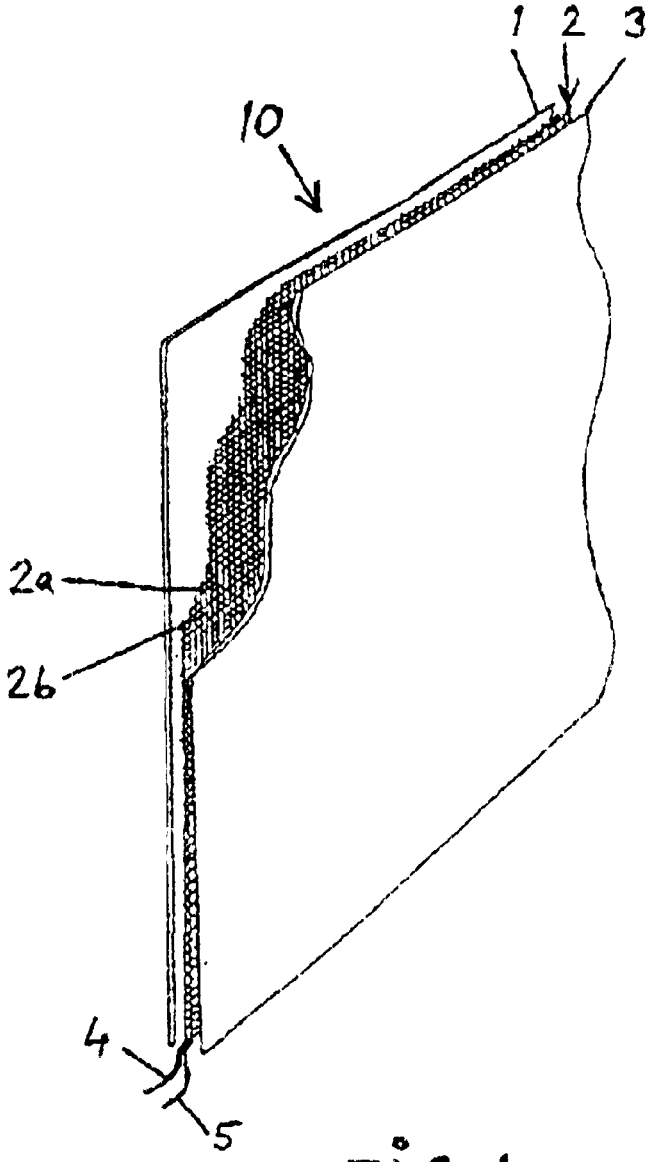

The present invention relates to a sheet element according to the preamble of claim 1. The intention also relates to a use of the sheet element as casing or lining material in a container or in a space intended for the storage of theft-attractive objects and similar objects.

WO 93/23648 describes a sheet element that includes an alarm-raising security mat and that can be used to particular advantage as casing material or lining in a security container fitted with alarm raising means or in a security space equipped with alarm raising means and intended for the storage of objects that shall be protected against unauthorised access.

The sheet element illustrated in WO 93/23648 includes an alarm mat comprised of one or more electrically conductive threads or corresponding devices that include insulating layers and that are disposed in continuous stitches, loops or eyes of the kind obtained when knitting or crocheting. An alarm mat of this construction is extremely effective in resisting interferences and disturbances from electromagnetic force fields, static electricity and similar phenomena.

Because of the fine-mesh structure of the mat included in the sheet element described in WO 93/23648, it is very difficult to force open the element without breaking a thread or wire and therewith raising an alarm and, for instance, without causing the destruction of valuable objects stored in a container that includes such a sheet element.

The object of the present invention is to provide a sheet element that includes an improved alarm mat which is still more difficult to force and even more difficult to manipulate than the above described alarm mat. This object is achieved with a sheet element that has the characteristic features set forth in the accompanying Claims.

Among the many advantages afforded by the invention, it can be mentioned that the sheet element can be given thin walls and made light in weight, therewith providing weight advantages with respect to the transport container in which the sheet element is used, among other things.

The inventive sheet element is constructed to deal with external interferences in the form of, e.g., magnetic fields, static electricity, radio int rferences, interference waves and similar phenomena in a highly effective manner.

The sheet element can be given an intrinsic rigidity such as to enable a self-supporting container to be constructed therefrom, for example.

The sheet element can be produced in desired shapes and curvatures, therewith also enabling containers of complicated shapes to be produced with the aid of the sheet element.

The walls of existing spaces, rooms, etc., can be covered or lined with inventive sheet elements to provide desired theft protection.

The inventive sheet element includes an alarm mat that has an eminent ability to withstand and extinguish interferences from electromagnetic force fields, static electricity and similar phenomena, therewith improving the possibilities of obtaining a quick reacting alarm raising device.

The inventive sheet element enables conditions to be provided for reliable burglary projection in the absence of resistance measurements, therewith reducing current consumption with respect to the alarm-raising device used.

The inventive sheet element includes an alarm mat which according to one particular embodiment of the invention is constructed to effectively prevent alarm-free penetration of the sheet element by heating the element or by some other temperature dependent manipulating process.

Figure 2:
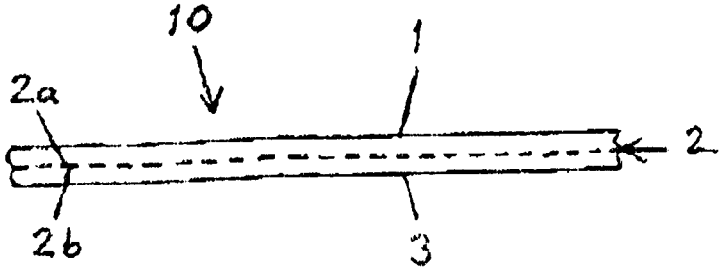
Figure 3A:
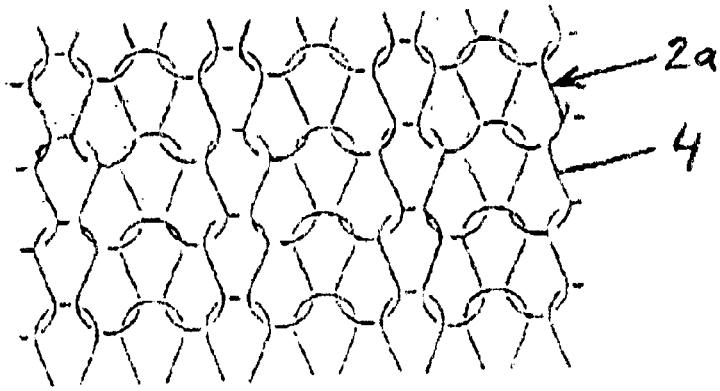
Figure 3B:
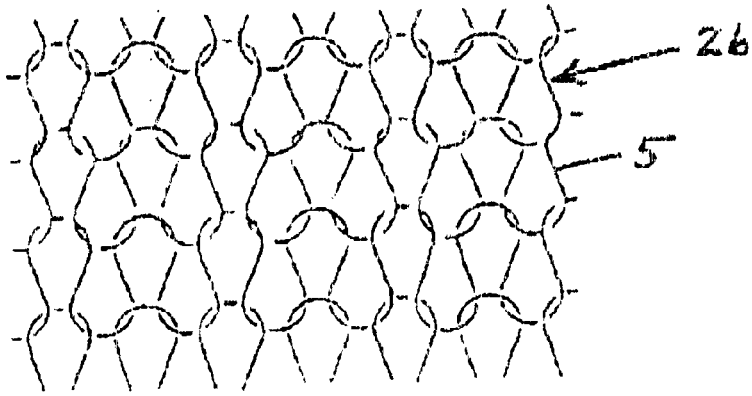
Figure 3C:
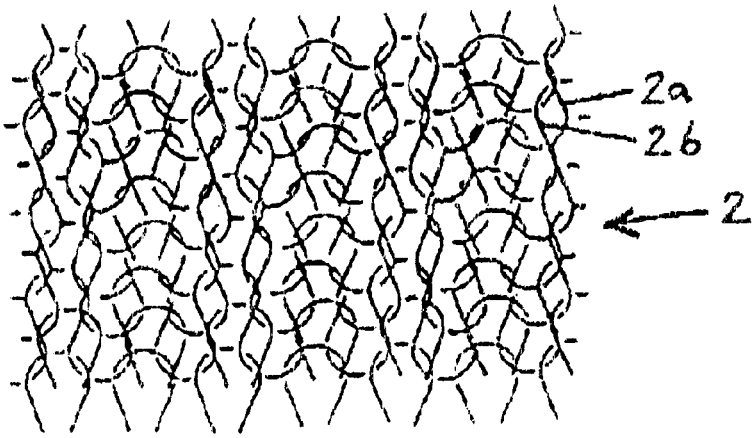
Figure 9:
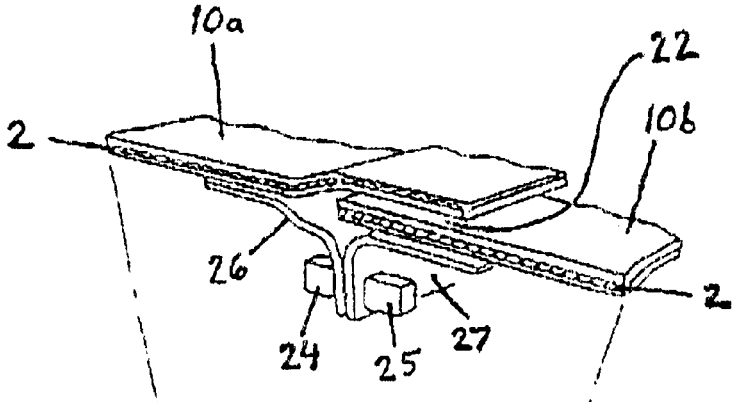

The invention will now be described with reference to exemplifying embodiments and also with reference to the accompanying drawings, in which FIG. 1 is an exploded perspective view illustrating the construction of an inventive sheet element; FIG. 2 is a schematic cross-sectional view of said sheet element; FIGS. 3*a*–3*c* illustrate schematically the manner in which an inventive alarm mat can be constructed, wherewith FIG. 3*a* is a schematic illustration of a base mat section; FIG. 3*b* is a schematic illustration of a supplementary mat section and FIG. 3*c* is a schematic illustration of a section of the complete alarm mat; FIGS. 4*a*–4*c* to FIGS. 7*a*–7*c* inclusive illustrate in a corresponding manner four further embodiments of inventive alarm mats; FIG. 8 is a perspective view of a transport container/security container constructed from inventive sheet elements; and FIG. 9 is a cross-sectional view of one embodiment of an openable overlap join between the sheet elements of the container shown in FIG. 8.

The sheet element 10 includes a first outer layer 1, an alarm mat 2, and a second outer layer 3 (see FIGS. 1 and 2).

The first outer layer 1 may consist of a glass fibre mat or a textile mat, although other types of mat, fabrics, materials, or panels may, of course, be used. The outer sheet 1 may alternatively consist of paint or a gel coating.

The alarm mat 2 is designed to indicate or detect attempts to force holes in the sheet element 10.

According to the present invention, the alarm mat 2 includes a base mat 2*a* and a supplementary mat 2*b*.

The base mat 2*a* is comprised of a fine-mesh filament mat that has been knitted, crocheted or woven, for instance. The material used in this respect is comprised of electrically conductive filaments 4 in the form of threads or ribbons made, e.g., of metal or electrically conductive plastic material. The threads 4 normally include an insulation layer and may comprise, for instance, a copper wire that is insulated with a layer of varnish of the kind commonly used in small electric motors. It can be mentioned by way of example that the filaments used may comprise varnished copper wire having a diameter of about 0.2 mm and given a mesh density or a mesh size of about 1 mm, although it will be understood that the invention is not restricted to this example. Optical fibres may also be used.

A characteristic feature of the base mat 2*a* resides in its generally regular pattern, and in one particularly preferred embodiment the base mat has a looped pattern of the kind obtained when knitting or crocheting, for instance. However, it is coinceivable to use looping patterns of different production and design. A loop pattern or ring pattern in which electric current flows in mutually opposite directions in respective adjacent loops or rings are particularly beneficial from an attenuation aspect or damping aspect with respect to rapid damping/extinguishing of interferences and disturbances in an alarm-raising circuit generated, e.g., by magnetic fields, static electricity or radio waves and similar phenomena.

Figure 5A:
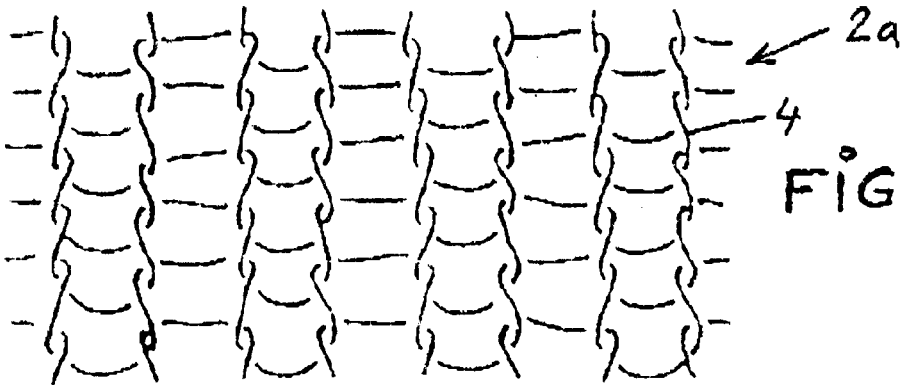
Figure 5B:
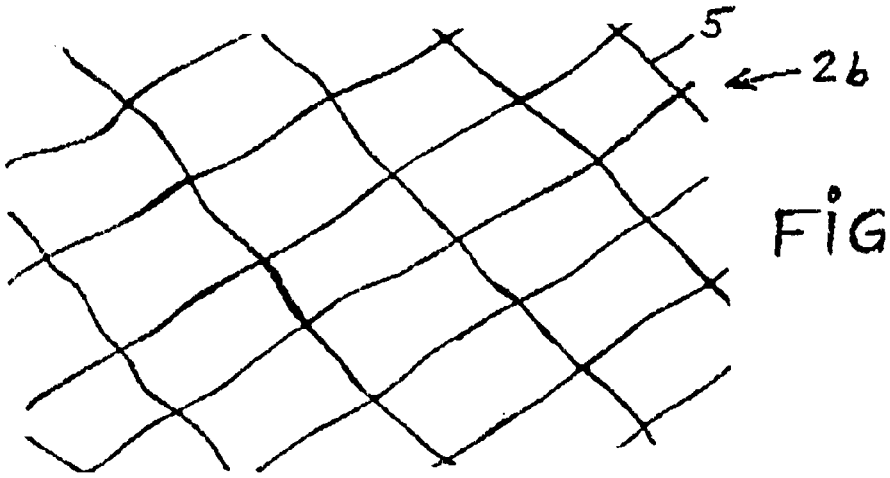
Figure 5C:
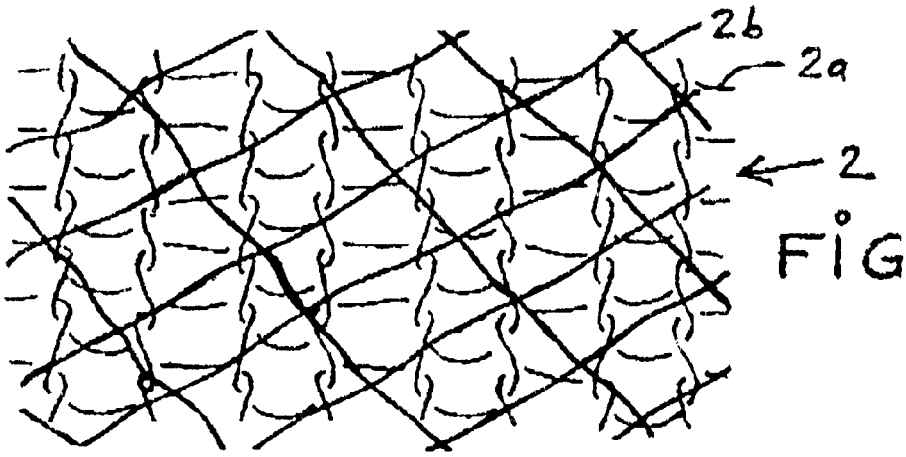
Figure 6A:
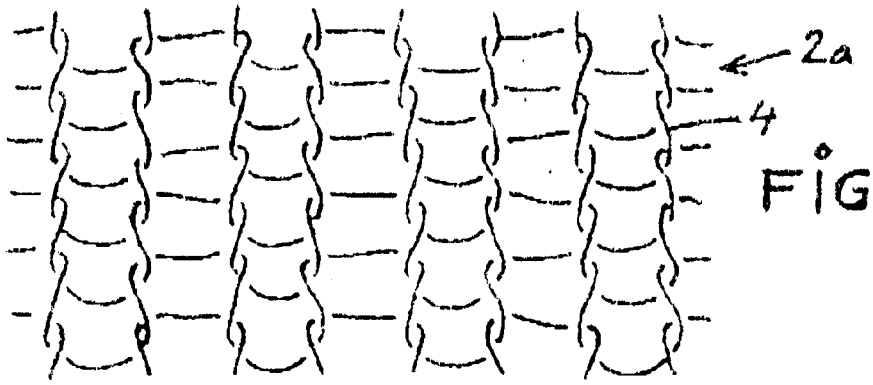
Figure 6B:
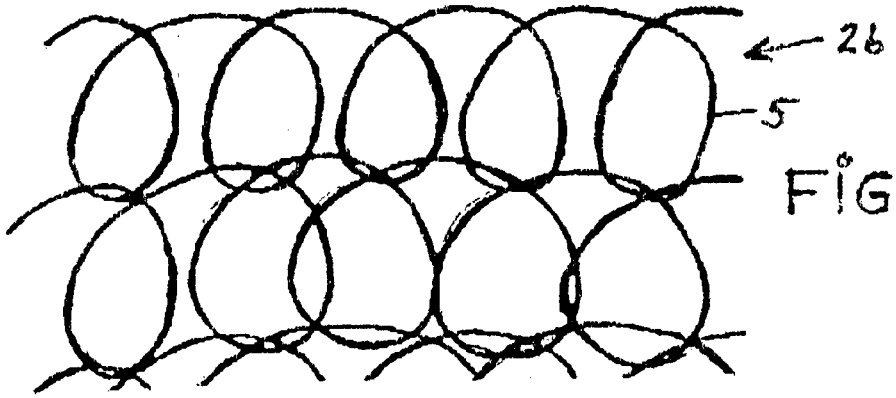
Figure 6C:
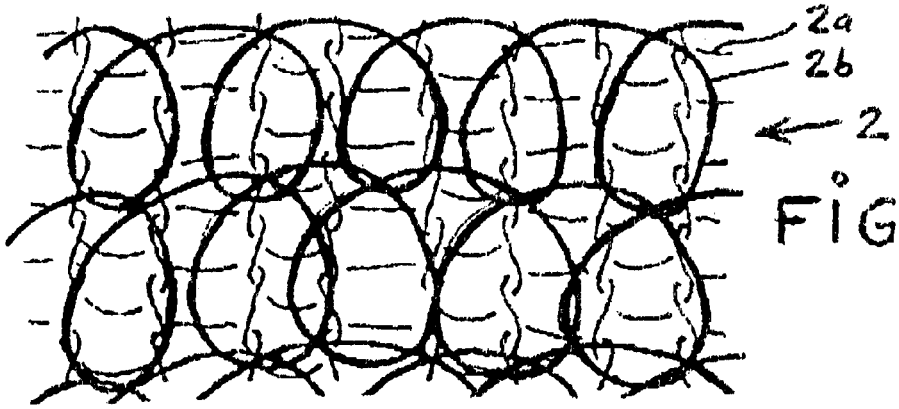
Figure 7A:
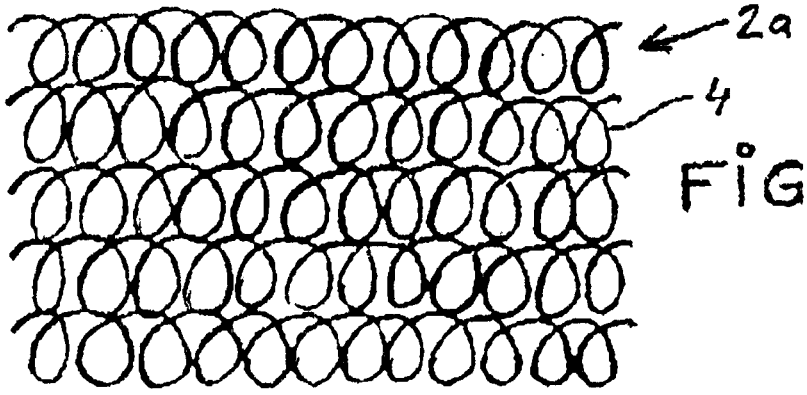

FIGS. 3*a*–7*a* illustrate different embodiments of the base mat 2*a*. FIGS. 3*a*–6*a* show the base mat 2*a* in a knitted pattern, while FIG. 7*a* shows the base mat 2*a* with a loop pattern of different design.

It will be understood that many variations are possible with respect to the design of the base mat, and that printed circuits or circuits produced in some other way in suitable patterns and, e.g., foil-mounted, can also be used within the scope of the present invention.

The supplemental mat 2*b* may have either a regular or irregular pattern and shape.

The supplemental mat 2*b* may, for instance, be a fine-mesh filament mat produced by knitting, crocheting or weaving. There is used in this respect an electrically conductive filament 5, in the form of, e.g., a thread, wire or ribbon of, e.g., metal or an electrically conductive plastic material. The filaments 5 are normally provided with an insulating layer. For instance, there can be used copper wire that includes an insulating varnished layer of the type used in small electric motors. As a non-limiting example, there may for instance be used a varnished copper wire that has a diameter of about 0.2 mm and a mesh density or mesh size of about 1 mm. It is also conceivable to use optical fibres.

FIG. 3*b* illustrates a knitted supplemental mat 2*b* that has roughly the name filament dimensions and mesh size as the base mat 2*a* in FIG. 3*a*.

Figure 4A:
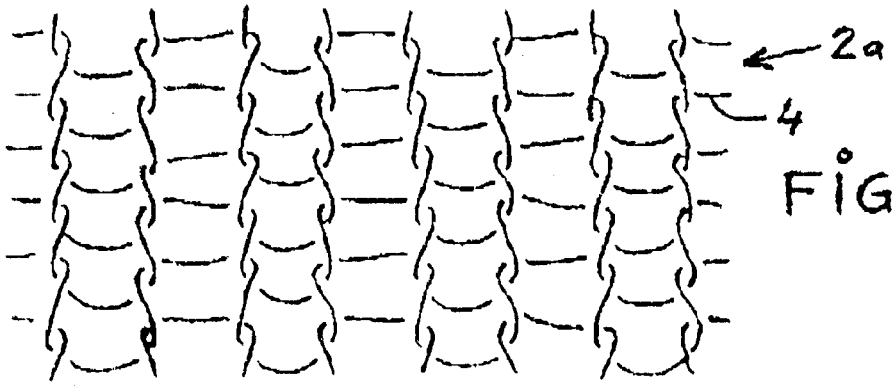
Figure 4B:
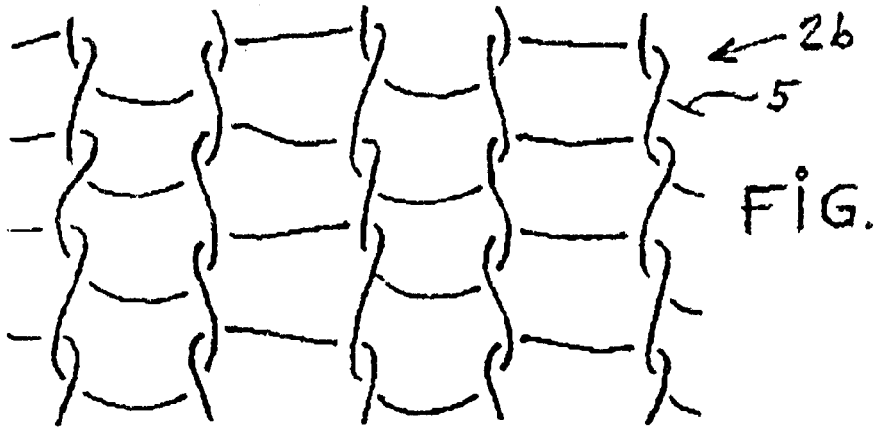

FIG. 4*b* illustrates a knitted supplemental mat 2*b* whose mesh size is larger than the mesh size of the base mat 2*a* in FIG. 4*a*. The filament dimensions are roughly the same as the filament dimensions of the base mat 2*a* and of the supplemental mat 2*b*. The supplemental mat 2*b* may have a mesh size that is about 1.5–10 times larger than the mesh size of the base mat 2*a*.

FIG. 5*b* illustrates an irregular supplemental mat 2*b* that can be integrated with the base mat 2*a* in FIG. 5*a* in several different ways.

FIG. 6*b* illustrates a regular supplemental mat 2*b* of looped construction, although not knitted. FIG. 6*a* shows a knitted base mat 2*a*.

Figure 7B:
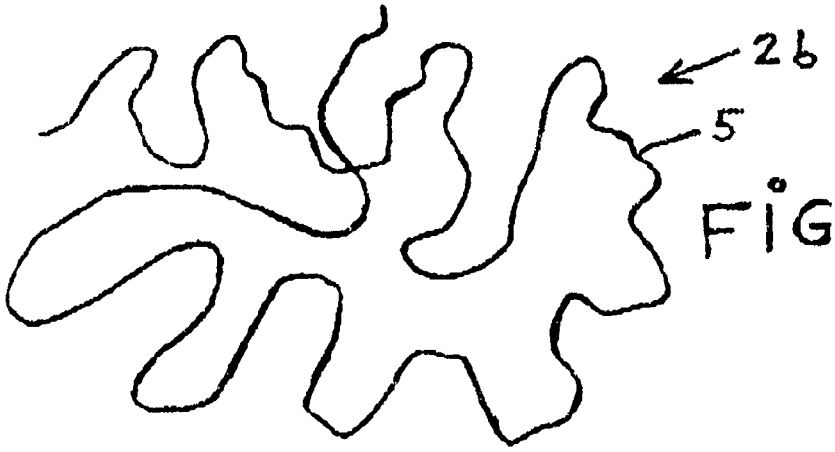
Figure 8:
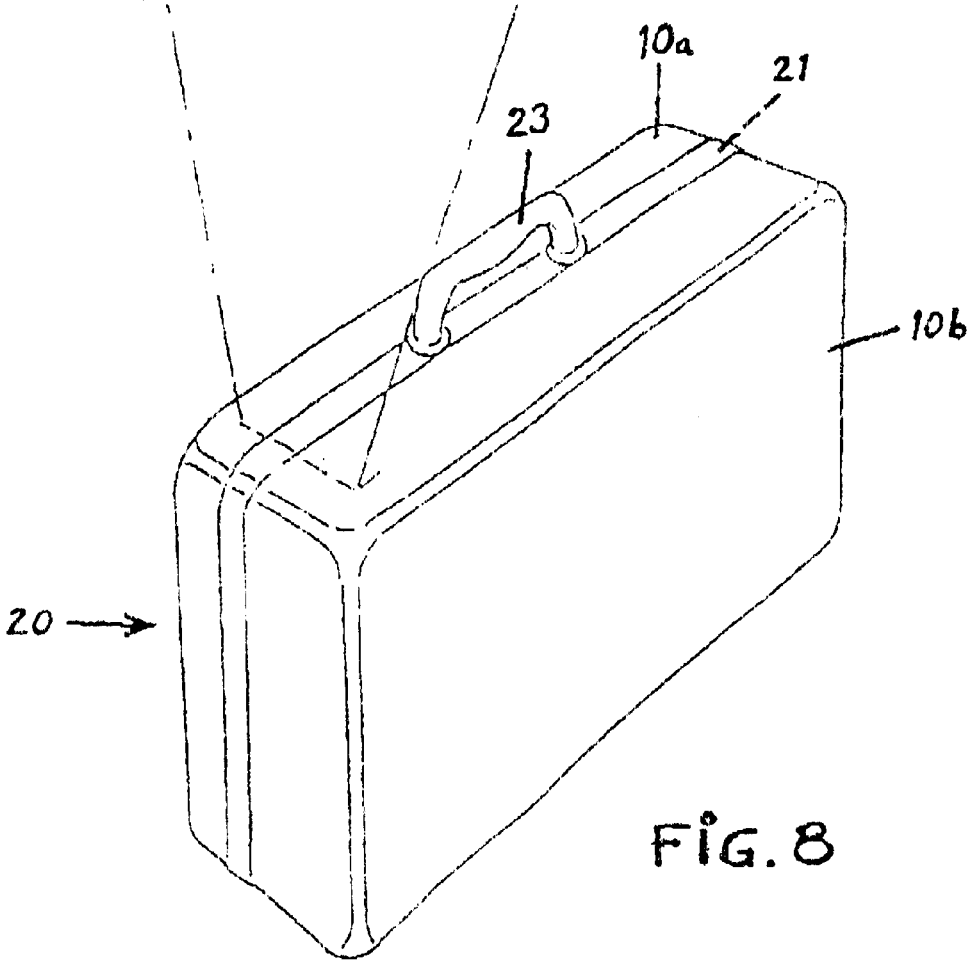

The supplemental mat 2*b* shown in FIG. 7*b* may have any desired shape and construction. FIG. 7*a* shows a base mat 2*a* of loop construction.

It will be apparent that many variations in the detailed construction of the supplemental mat are possible, and that printed circuits or circuits formed in some other way in appropriate patterns mounted, e.g., on foil are conceivable for use within the scope of the invention.

One characteristic feature of the supplemental mat 2*b* is that it may be both regular or irregular with respect to its pattern and shape. In one particularly preferred embodiment, the supplemental mat has a knitted or crocheted loop pattern. However, loop patterns other than knitted or crocheted patterns can be used. The loop or ring pattern in which mutually adjacent loops carry current in mutually opposite directions are particularly beneficial from the aspect rapidly damping/extinguishing interference generated in the alarm-raising circuit by magnetic fields, static electricity, radio waves or like phenomena, for instance. Although a supplemental mat 2*b* that has an irregular pattern and shape does not posses the same good interference damping properties as a mat of regular shape and pattern, its interference damping properties can nevertheless be accepted when used together with a base mat 2*a*, at least for some applications.

According to the present invention, the alarm mat 2 is thus comprised of a base mat-supplemental mat-combination, as shown by way of example in FIGS. 3*c*–7*c*.

FIG. 3*c* illustrates an alarm mat 2 which comprises the base mat 2*a* of FIG. 3*a* and a supplemental mat 2*b* of FIG. 3*b* superimposed on the base mat 2*a*. The base mat 2*a* and the supplemental mat 2*b* have, in this case, roughly the same pattern, shape and size and are tightly brought together or tightly pressed together to form the alarm mat 2. In the illustrated case, the supplemental mat 2*b* is displaced parallel with the base mat 2*a* such that the pattern resulting from the combined mats will be extremely bewildering and difficult to manipulate when the alarm mat 2 is included as an integrated layer in the complete sheet element or laminate 10.

Figure 4C:
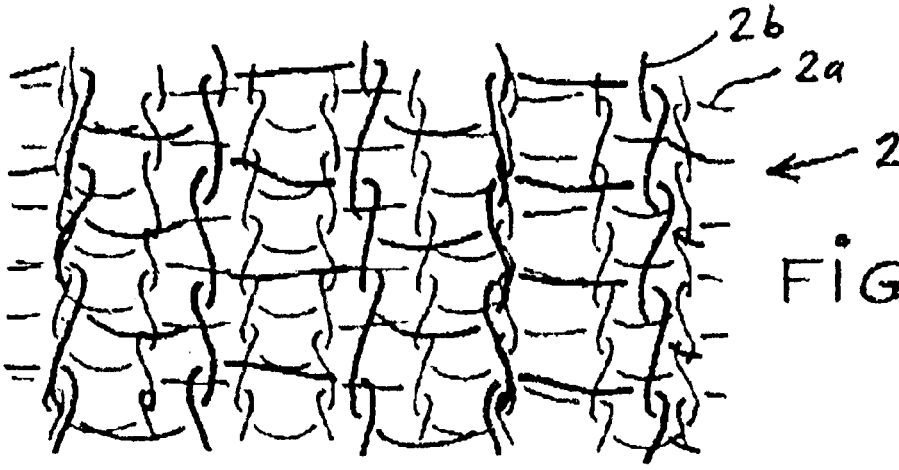

FIG. 4*c* illustrates an alarm mat 2 that comprises a combination of the base mat 2*a* shown in FIG. 4*a* and the supplemental mat 2*b* shown in FIG. 4*b*.

FIG. 5*c* illustrates an alarm mat 2 that comprises a combination of the base mat 2*a* shown in FIG. 5*a* and the supplemental mat 2*b* shown in FIG. 5*b*. The supplemental mat 2*b* is either simply placed on the base mat 2*a* or is, e.g., sewn thereto.

FIG. 6*c* illustrates an alarm mat 2 that comprises a combination of the base mat 2*a* shown in FIG. 6*a* and the supplemental mat 2*b* shown in FIG. 6*b*.

Figure 7C:
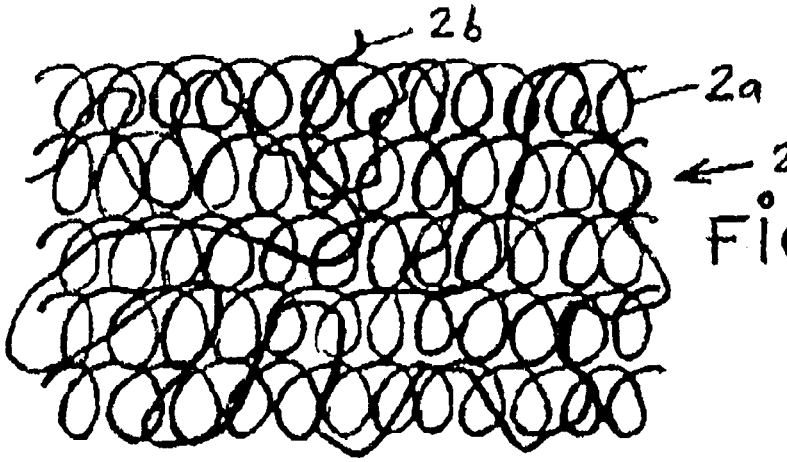

FIG. 7*c* illustrates an alarm mat 2 that comprises a combination of the base mat 2*a* shown in FIG. 7*a* and the supplemental mat 2*b* shown in FIG. 7*b*. It will be understood that many variations and combinations are possible within the scope of the invention.

A common feature of all embodiments of the alarm mat 2 resides in the complexity of the combined mat patterns that arrive from the tight combination or tight mutual compression of the base mat 2*a* and the supplemental mat 2*b*. The construction of the alarm mat 2 is particularly difficult to analyse when said mat constitutes a compressed layer in the finished, and normally opaque, sheet element 10.

The alarm-thread-free surfaces of the sheet element will be smaller than if only a base mat is used instead of the inventive mat combination.

It will be evident that many combinations between inventive base mats and supplemental mats are possible within the scope of the inventive concept. The patterns, sizes and orientations of the base mats and supplemental mats can be varied and the mats can be joined together in many different ways as required. It may normally suffice to lay the mats tightly against one another or to press the mats into mutual abutment without bonding the mats one to the other, as the alarm mat is integrated in the sheet element.

If desired, the base mat and/or the supplemental mat may comprise double filaments. The number of electric circuits in the alarm mat may, of course, be varied from one electric circuit to a plurality of circuits within the scope of the intention. The base mats and the supplemental mats may be connected in series or in parallel according to wishes and requirements, so as to obtain desired current flows in the alarm-raising circuit in question.

The filaments in the base mat and/or in the supplemental mat need only be insulated at filament interjections or where filaments contact each other. For instance, when one mat is constructed from insulated filaments and the other mat lacks filament intersections, the other mat need not include insulated filaments. However, it is convenient for all filaments to be insulated for practical reasons, even though it is not always necessary.

It will be understood that the supplemental mat may be excluded from the alarm-raising circuit that the alarm mat, or security mat, is intended to include, or the base mat and the supplemental mat may be connected to mutual separate alarm-raising circuits and/or alarm-raising devices. Many variations are, of course, possible within the scope of the invention.

Appropriate parts of the above reasoning are applicable to optical fibres, although with requisite adaptation.

The inventive alarm mat is very capable of resisting interferences emanating from electromagnetic force fields, static electricity, radio waves and like phenomena.

The technical requirement of an alarm-raising mat 2, such as its mesh density, the number of electric circuits included, its flexibility, etc., constitutes control factors in the choice of the manufacturing method applied. One or more electric signals is/are sent through the alarm mat 2 and in the event of an attempt to force a hole in the sheet element 10 being made, the electric signal in the mat is broken as a result of a filament breakage, therewith triggering an alarm. Correspondingly, the same will apply to light signals when optical fibres are used.

The other surface layer 3 is suitably constructed in the same manner or in a similar manner to the first outer layer 1. When suitable, the second surface layer 3 may consist of a thin layer of varnish.

In the majority of cases, the sheet element 10 is applied so that the surface layer 1 forms the exterior of the container/space and the surface layer 3 is proximal to the container interior, and consequently the surface layers may vary with respect to finish and construction.

In the manufacture of the sheet element 10, the layers 1–3 are joined together, for instance, by means of a gluing, injection, or pressing process. A number of different binding agents can be used in this regard, such as polyester resin or other resins, for instance, therewith enabling a stable sheet element to be formed. In this regard, it will be understood that the sheet element may be given a number of different shapes in addition to a planar fundamental shape, wherewith a security container or security bag consisting solely of two curved laminate parts that overlap each other in the joint region of said parts can be produced. FIG. 8 shows an example of a transport container or case 20 constructed in this way.

The case 20 illustrated in FIG. 8 is thus comprised of two specially shaped inventive sheet element parts 10*a* and 10*b*, wherewith said sheet element parts are configured so that when the case is closed they will be brought together in an overlap zone 21 with the smallest possible gap 22 therebetween. The case 20 is conveniently provided with a handle 23 glued on the outside of the case, and with glued-on hinges and locking devices, etc., such that no holes are present in the sheet element parts. A number of contact devices or detection devices 24, 25 are disposed immediately inwards of the overlapping part 21, said devices 24 being carried by a strip 26 glued to the sheet element part 10*a*, and the devices 25 being carried by a strip 27 glued to the sheet element part 10*b*. The strips 26 and 27 will preferably extend around the whole of the case perimeter and will carry an appropriate number of contact devices 24, 25. The alarm mats 2 of the sheet elements 10*a* and 10*b* form a security cage and the contact devices 24 and 25 are interconnected so as to be included in one or more signal current circuits. The signal current circuits break when an attempt to force a hole in the case breaks a filament 4, 5 in the alarm mat 2. In this respect, it will be understood that the alarm mat 2 is present everywhere around the entire surface of the case or container 20. Naturally, there will be an alarm mat overlap at part 21. The signal current circuit will also be broken if an attempt is made to bend the gap 22 apart, in an attempt to obtain access to the case interior, wherewith breaking of the electric circuit breaks the electric contact between the devices 24 and 25 by virtue of a change in the distance between said devices in conjunction with this bending action.

Arranged inside the transport container or case 20 is an electronic unit and, e.g., one or more ampoules or cartridges that contain a destructive agent, for instance dye containing cartridges. The electronic unit is adapted to activate the destructive cartridges immediately the signal current circuit is broken, so as to destroy the valuable contents of the container 20. Activation and deactivation of the alarm system/the electronic unit is effected by some appropriate code system that has a high security level. The container will, of course, also contain an electric power source. In this regard, it is also possible to pre-set a time at which the destructive agent will be triggered, with the intention of introducing a further stress factor for potential criminals.

With regard to the inventive security container 20, tests carried out in practice have shown that in addition to its function as protection against perforation of the container, the inventive alarm mat 2 also functions as a particularly effective means of protection against external interferences from, e.g., different types of magnetic fields and electrostatic fields, radio waves and similar phenomena, as a result of dampening voltage or interferences caused by these phenomena so rapidly that the reaction time of the electronic unit can be given a time duration that is so short that there will be no time to disarm the destructive agent before it is activated, even by firing a bullet from a high velocity weapon directly onto the activation means of the destructive element. Because of this extremely rapid interference dampening effect, the risk of the destructive agent being triggered as a result of a false alarm due to external interference is reduced. One filament and one electric circuit affords in many cases sufficient protection against external interferences in the form of strong magnetic fields and transient voltages. The inventive alarm mat 2 thus highly effective prevents interferences and disturbances on, e.g., electronic and computer equipment contained inside the container 20 comprised of the sheet elements 10.

It will be understood that many different possibilities exist in producing a refined security system based on the use of the inventive sheet element 10.

The aforedescribed case or container 20 is thus extremely suitable for use in transporting different kinds of valuable objects.

The inventive sheet elements 10 can thus be used in the construction of containers, rooms or other mobile or permanent spaces where it is desired to prevent access by e.g. forcing holes in the structure. If an attempt to force a hole is made, some form of destructive agent will be activated so as to render the material stored in the space worthless or unusable, or will result in the activation of an alarm. An overlapping drilling guard is provided at joins and doors, and contacts that function to break a signal circuit if an attempt to bend away material is made are disposed inwardly of the joins. These contacts are suitably connected in series with the alarm mats, so as to keep down the number of electric circuits.

As non-limiting examples the inventive sheet element can be used in e.g. cases, bags, or other containers for the transportation of valuable objects, such as money transportation, security containers for motor vehicles and aircraft, weapon storage facilities, inexpensive bank vaults, etc.

Thus, different containers, localities and spaces can be provided with a shell constructed from the inventive sheet element, therewith rendering unauthorised access impossible to achieve without activating an alarm or destructive equipment.

It will be understood that the construction of the inventive sheet element can be varied in many different ways. In its simplest form, the sheet element may consist of solely one alarm mat and one outer layer, provided that bonding of the alarm mat to the outer layer is sufficiently effective. The sheet element may alternatively include additional layers of different kinds if so desired. Material selection may, of course, also be varied. A thickness of about 2–5 mm is an example of suitable sheet element thickness, although said sheets are not restricted to such thicknesses. The sheet element will most often be opaque, for obvious reasons. The alarm mat may suitably be baked or cast in the sheet element, or firmly glued thereto. The sheet element may include stiffening means. The alarm mat is normally continuous and covers the entire sheet element.

In one particular embodiment of the invention, the base mat 2*a* and the supplemental mat 2*b* are comprised of filaments that have mutually different melting points. For instance, the base mat 2*a* may be comprised of a copper wire and the supplemental mat 2*b* comprised of a metal wire that has a relatively low melting point in comparison with the melting point of the copper wires. If an attempt is made to penetrate the sheet element without triggering an alarm by heating or some other temperature raising manipulation, the wires in the supplemental mat will melt first and therewith initiate an alarm. If desired, the melting point of the wire in the base mat can of course be lower than the melting point of the wire in the supplemental mat.

Instead of continuous currents, varying pulse trains way be sent in the base mat and the supplemental mat for creating confusion. This further enhances the problems associated with attempts to manipulate the system.

In the series production of products that include inventive sheet elements, the construction of the alarm mat in said elements can be varied continuously with the intention of causing confusion, even within the same product or product program. These variation possibilities make mapping of the alarm mat construction impossible and therewith provide an extraordinarily high security level.

When light-conducting optical fibres are used instead of electrically conductive filaments, it will, of course, be understood that peripheral equipment must be adapted in respect thereof, and that earlier comments made with respect to electric circuits will, instead, relate to light circuits.

It will also be understood that the invention is not restricted to the illustrated and described embodiments and that changes and modifications are conceivable within the scope of the accompanying Claims.

What is claimed is:

1. A sheet element (10) which has integrated therewith an alarm mat (2) and which is intended particularly for security containers and security spaces, wherein the alarm mat (2) is comprised of current-conducting filaments or corresponding devices, characterised in tht the alarm mat (2) comprises a base mat (2*a*) and a supplemental mat (2*b*), in that the base mat (2*a*) has an essentially looped filament pattern in that the base mat (2*a*) and the supplemental mat (2*b*) are positioned together to form an alarm mat (2); and in that the filament pattern of the base mat (2*a*) and the filament pattern of the supplemental mat (2*b*) deviate from a totally coincidental overlap.

2. A sheet element according to claim 1, characterised in that the supplemental mat (2*b*) has a regular or an irregular filament pattern.

3. A sheet element according to claim 1, characterised in that the base mat (2*a*) and the supplemental mat (2*b*) are manufactured by a knitting or crocheting process; and in that said mats have mutually different mesh sizes.

4. A sheet element according to claim 1, characterised in that the filaments of the supplemental mat (2*b*) have a melting point that differs from the melting point of the filaments in the base mat (2*a*).

5. A sheet element according to claim 1, characterised in that the sheet element (10) includes at least one outer layer (1) joined to the alarm mat (2); and in that the sheet element (10) has a planar, curved or angled shape.

6. A method of using a sheet element according to claim 1 as a casing, the steps of said method characterised in that said sheet element (10) is used as a casing in a container (20) or in a space that is adapted for the storage of objects to be protected against unauthorised access.

7. The method according to claim 6, characterised in that a plurality of said sheet elements (10) are joined with an overlap; and in that at least a plurality of the base mats (2*a*) are coupled to an alarm system.

8. The method according to claim 7, characterised in that a plurality of the supplemental mats (2*b*) are coupled to an alarm system.

9. The method according to claim 6, characterised in tht the construction of the alarm mat of the sheet element (10) is varied from container/space (20) to container/space (20), or is varied within one and the same container/space (20) so as to make mapping of the construction of the alarm mat (2) difficult to achieve.

10. A method of manufacturing sheet elements according to claim 1, the steps of said method characterised by varying the construction of the alarm mat of said sheet element (10).

11. A sheet element according to claim 1, characterised in that the base mat (2*a*) is manufactured by a knitting or crocheting process.

12. A sheet element according to claim 2, characterised in that the filaments of the supplemental mat (2*b*) have a melting point that differs from the melting point of the filaments in the base mat (2*a*).

13. A sheet element according to claim 3, characterised in that the filaments of the supplemental mat (2*b*) have a melting point that differs from the melting point of the filaments in the base mat (2*a*).

14. A sheet element according to claim 2, characterised in that the sheet element (10) includes at least one outer layer (1) joined to the alarm mat (2); and in that the sheet element (10) has a planar, curved or angled shape.

15. A sheet element according to claim 3, characterised in that the sheet element (10) includes at least one outer layer (1) joined to the alarm mat (2); and in that the sheet element (10) has a planar, curved or angled shape.

16. A sheet element according to claim 4, characterised in that the sheet element (10) includes at least one outer layer (1) joined to the alarm mat (2); and in that the sheet element (10) has a planar, curved or angled shape.

17. The method according to claim 7, characterised in that the construction of the alarm mat of the sheet element (10) is varied from container/space (20) to container/space (20), or is varied within one and the same container/space (20).

18. The method according to claim 8, characterised in that the construction of the alarm mat of the sheet element (10) is varied from container/space (20) to container/space (20), or is varied within one and the same container/space (20).

19. A method of manufacturing sheet elements according to claim 2, the steps of said method characterised by varying the construction of the alarm mat of said sheet element (10).

20. A method of manufacturing sheet elements according to claim 3, the steps of said method characterised by varying the construction of the alarm mat of said sheet element (10).

* * * * *